US005221090A

United States Patent [19]

Hong

[11] Patent Number: 5,221,090

[45] Date of Patent: Jun. 22, 1993

[54] GOLF TEE

[76] Inventor: Bum K. Hong, 105-903, Hyundai first APT, 653 Gaepo-dong, Kangnam-gu, Seoul, Rep. of Korea

[21] Appl. No.: 875,178

[22] Filed: Apr. 28, 1992

[51] Int. Cl.[5] ..... A63B 57/00

[52] U.S. Cl. ..... 273/203; 273/211; 273/33

[58] Field of Search ..... 273/33, 202-212, 273/200 R, 208

[56] References Cited

U.S. PATENT DOCUMENTS

| | | | |
|---|---|---|---|
| 1,550,483 | 8/1925 | Wulkop | 273/208 |
| 1,803,907 | 5/1931 | Kruse | 273/202 |
| 2,668,710 | 2/1954 | Carlson | 273/208 |

FOREIGN PATENT DOCUMENTS

| | | | |
|---|---|---|---|
| 290906 | 5/1928 | United Kingdom | 273/208 |
| 9947 | 11/1932 | United Kingdom | 273/208 |

*Primary Examiner*—Theatrice Brown

*Attorney, Agent, or Firm*—Lowe, Price, LeBlanc & Becker

[57] ABSTRACT

A golf tee which can be used on a mat as well as a lawn ground irrespective of the kinds of golf clubs by combination of the cylindrical tee member adapted to be used on a mat and the stick shaped tee member adapted to be used on a lawn ground. The golf tee comprises a cylindrical tee member having a stop plate at a predetermined portion of an inner surface thereof, and a stick shaped tee member having a head part and a leg part which may be detachably fitted into the inside of the cylindrical through a lower end of the cylindrical tee member. Therefore, it is convenient to keep and carry the golf tees.

1 Claim, 1 Drawing Sheet

GOLF TEE

BACKGROUND OF THE INVENTION

1. Field of the Invention

The present invention relates to a golf tee, and more particularly a golf tee which includes a cylindrical tee member adapted to be used as a long tee as well as a short tee on a mat and a stick shaped tee member formed with a tray shaped head part at an upper portion thereof, thereby enabling the golf tee to be used on a mat as well as a lawn ground by fitting the cylindrical tee member to the stick shaped tee member.

2. Description of the Prior Art

Recently, many people enjoy golf as means for employing spare time well and make friends or means for relieving fatigue and boredom resulted from repeated workshop life, and the number of the people enjoying a golf is on an increasing trend.

Conventional golf tees are generally classified into two classes of tees, that is, a long tee adapted to be used for a wood club and a short tee adapted to be used for an iron club in accordance with using condition. In accordance with using manner, there are a stick shaped tee having a pointed end adapted to be stuck in the ground and then used, and a cylindrical tee having a flat bottom surface adapted to be placed on a mat or fitted to the stick shaped tee and then used.

However, the conventional golf tees have disadvantages as follows. When the stick shaped tee is used on a mat, it is not easy to install the stick shaped tee to a mat by sticking the tee in a proper gap of the mat. Also, when the cylindrical tee is used on a lawn ground, it is difficult to fix the cylindrical tee on the lawn ground without movement of the tee.

SUMMARY OF THE INVENTION

The present invention has been made in view of the above-described prior art problems and an object of the invention is to provide a golf tee which can be used on a mat as well as a lawn ground irrespective of the kinds of golf clubs by combination of the cylindrical tee member adapted to be used on a mat and the stick shaped tee member adapted to be used on a lawn ground.

In accordance with the present invention, the object mentioned above can be accomplished by providing a golf tee comprising a cylindrical tee member having a stop plate at a predetermined portion of an inner surface thereof, and a stick shaped tee member having a head part and a leg part which may be detachably fitted into the inside of the cylindrical through a lower end of the cylindrical tee member.

BRIEF DESCRIPTION OF THE DRAWINGS

These and other objects, features and advantages of the invention will become more apparent upon a reading of the following detailed specification and drawings, in which.

DETAILED DESCRIPTION OF THE PREFERRED EMBODIMENTS

Figure 1:
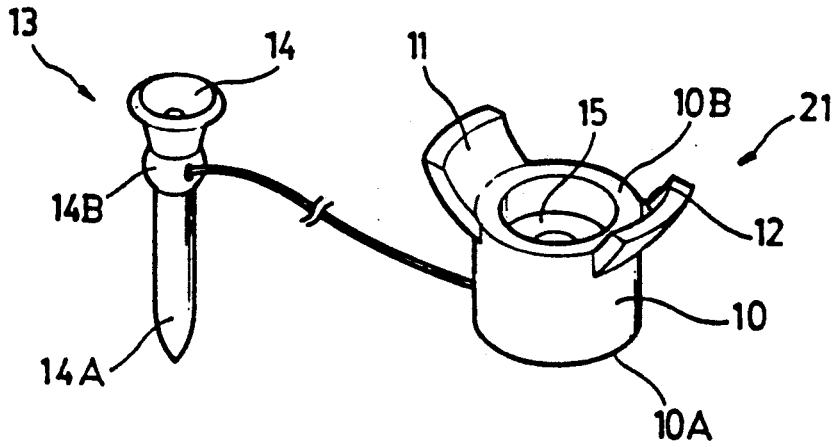
FIG. 1 is a perspective view representing an embodiment of a golf tee according to the present invention.
Figure 2:
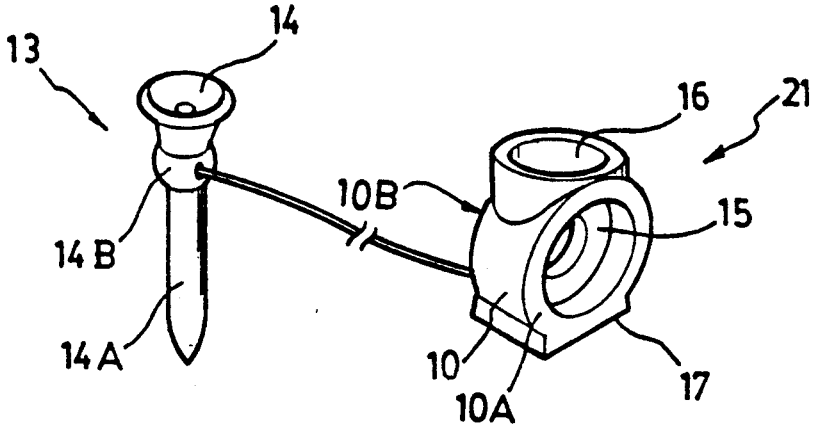
FIG. 2 is a perspective view representing another embodiment of a golf tee according to the present invention.
Figure 3:
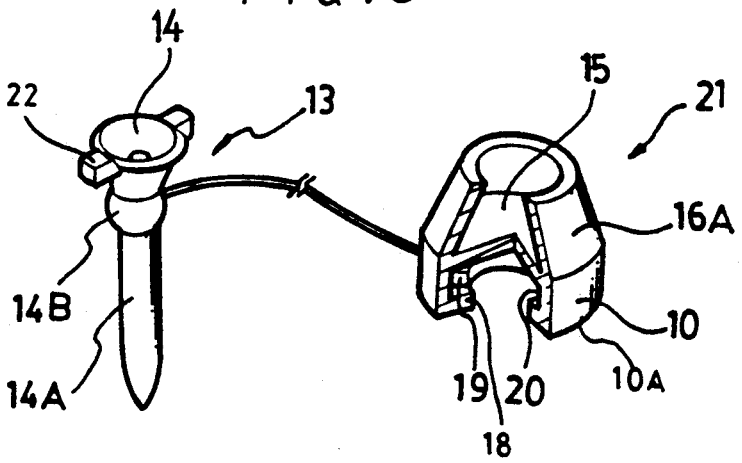
FIG. 3 is a perspective view representing still another embodiment of a golf tee according to the present invention.

The present invention will now be described by referring to FIGS. 1 to 3 in the accompanying drawings, wherein since structures of elements of golf tees according to the present invention are substantially equal to one another, the substantially identical or similar elements to one another which are illustrated in FIGS. 1 to 3 are designated by the similar reference characters.

Referring now to FIG. 1, there is shown a golf tee according to a first embodiment of the present invention. The golf tee includes a cylindrical tee member 21 and a stick shaped tee member 13 adapted to be inserted in the inside of the cylindrical tee member 21 at head portion 14 thereof. The cylindrical tee member 21 comprises a cylinder 10 having an open upper end 10B and an open lower end 10A, a pair of curved wing parts 11 and 12 which are formed at opposite sides of an upper portion of an outer surface of the cylinder 10 and which are radially outwardly and upwardly extended, and an annular stop 15 formed at a middle portion of an inner surface of the cylinder 10. The stick shaped tee member 13 comprises a tray shaped head part 14 on which a golf ball (not shown) is seated and a leg part 14A extended from the head part 14. The leg part is integrally formed with an annular protrusion 14B at an upper portion thereof and a pointed bottom at a lower end thereof. The stick shaped tee member 13 may be detachably fitted to the cylindrical tee member 21 by inserting the head part 14 of the stick shaped tee member 13 into the inside of the cylindrical tee member 21 through the lower end of the cylindrical tee member. The cylindrical tee member 21 and the stick tee member 13 may be used in the state of fitted together or separately in accordance with using condition.

Referring to FIG. 2, there is shown a golf tee according to a second embodiment of the present invention. As shown in FIG. 2, the golf tee includes a cylindrical tee member 21 and a stick shaped tee member 13 which is substantially similar to the stick shaped tee member 13 shown in FIG. 1. The cylindrical tee member 21 comprises a cylinder 10 having an open upper end 10B and an open lower end 10A, a cylindrical head part 16 formed at a side of an outer surface of the cylinder 10, a flat supporting part 17 formed at the opposite side of the outer surface of the cylinder 10, and an annular stop 15 formed at a middle portion of an inner surface of the cylinder 10. Since the stick shaped tee member 13 according to this embodiment is substantially equal to the stick shaped tee member 13 shown in FIG. 1, a detailed description thereof will be omitted. Likewise, the cylindrical tee member 21 and the stick tee member 13 may be used in the state of fitted together or separately in accordance with using condition.

Referring to FIG. 3, there is shown a golf tee according to a third embodiment of the present invention. The golf tee according to third embodiment of the present invention also includes a cylindrical tee member 21 and a stick shaped tee member 13 adapted to be inserted in the inside of the cylindrical tee member 21 at head portion 14 thereof. The cylindrical tee member 21 comprises a cylinder 10 having a closed upper plate 15 and an open lower end 10A, and a frustoconical part 16A on which a golf ball is seated. The cylinder 10 is provided with an inner rib 18 at inner circumference of the open lower end 10A thereof so that a circumferential groove 20 is provided between the upper plate 15 and the inner rib 18. The inner rib is formed with a pair of cut portions 19 at opposite sides thereof. In this embodiment, the stick shaped tee member 13 is substantially equal to the stick shaped tee members 13 shown in FIGS. 1 and 2 but formed with a pair of lugs 22 at opposite sides of the head part 14 thereof. Accordingly, when the stick shaped tee member 13 is fitted to the cylindrical tee member 21, the lugs 22 of the stick shaped tee member 13 are passed trough the corresponding cut portions 19 respectively and then rotated clockwise or counterclockwise so that the stick shaped tee member 13 is fixedly fitted to the cylindrical tee member 21.

Operations of the golf tees mentioned above will be described hereinafter.

First, when the golf tees are used as long tees on a mat, in case of the golf tee shown in FIG. 1, after the cylindrical tee member 21 is inverted and horizontally placed to the mat so that the upper ends of wing parts 11 and 12 are contacted with the mat, a golf ball is seated on the open lower end 10A and then drove by a golfer. In case of the golf tee shown in FIG. 2, after the cylindrical tee member 21 is placed to the mat such that the flat supporting part 17 is contacted with the mat, a golf ball is seated on the cylindrical head part 16 and then drove. In case of the golf tee shown in FIG. 3, after the cylindrical tee member 21 is horizontally placed to the mat such that the lower end 10A is contacted with the mat, a golf ball is seated on the frusto-conical part 16A and then drove.

Second, when the golf tees are used as short tees on a mat, in case of the golf tee shown in FIG. 1, after the cylindrical tee member 21 is horizontally placed to the mat such that the open lower end 10A is contacted with the mat, a golf ball is seated on the open upper end 10B and then drove by a golfer. In case of the golf tee shown in FIG. 2, after the cylindrical tee member 21 is horizontally placed to the mat such that the open lower end 10A is contacted with the mat, a golf ball is seated on the open upper end 10B and then drove.

Third, when the golf tees are used as long tees on a lawn ground, in case of the golf tee shown in FIG. 1, the leg part 14A of the stick shaped tee member 13 is generally stuck in the ground to a depth of about 2 cm, that is, the leg part 14A is stuck in the ground until the annular protrusion 14B formed at the upper portion of the leg part 14A is substantially flushed with the surface of ground. The cylindrical tee member 21 is fitted to the stick shaped tee member 13 by inserting the cylindrical tee member 21 on to the head part 14 of the stick shaped tee member 13 through the open lower end 10A of the cylindrical tee member 21 until the head part 14 reaches the lower surface of annular stop 15. Thereafter, a golf ball is seated on the open upper end 10B. In case of the golf tee shown in FIG. 2, the stick shaped tee member 13 is stuck in the ground in the same manner as that of the stick shaped tee member 13 shown in FIG. 1. Likewise, the cylindrical tee member 21 is fitted to the stick shaped tee member 13 in the same manner as that of the cylindrical tee member 21 shown in FIG. 1. Thereafter, a golf ball is also seated on the open upper end 10B. In case of the golf tee shown FIG. 3, the stick shaped tee member 13 is stuck in the ground in the same manner as that of the stick shaped tee members 13 shown in FIGS. 1 and 2. The cylindrical tee member 21 is fitted to the stick shaped tee member 13 by causing the lugs 22 of the stick shaped tee member 13 to be passed through the corresponding cut portions 19 respectively and then the cylindrical tee member 21 to be rotated clockwise or counterclockwise. Thereafter, a golf ball is seated on the frusto-conical part 16A.

Finally, when the golf tees are used as short tees on a lawn ground, after the stick shaped tee members 13 are stuck in the ground as mentioned above, a golf ball is seated on the head parts 14 of the stick shaped tee members 11.

As apparent from the above description, since golf tees according to the present invention can be used on a mat as well as a lawn ground irrespective of the kinds of golf clubs by combination of the cylindrical tee member adapted to be used on a mat and the stick shaped tee member adapted to be used on a lawn ground, it is easy to keep and carry the golf tees, thereby increasing convenience of a golfer. In addition, when a long tee is used for a wood club, shock which is generated from a golf ball at the time of hitting ball can be absorbed in the cylindrical tee member by fitting the cylindrical tee member made of soft synthetic resin material such as rubber to the stick shaped tee member, thereby protecting the face portion of wood club.

Although the preferred embodiments of the invention have been disclosed for illustrative purpose, those skilled in the art will appreciated that various modifications, additions and substitutions are possible, without departing from the scope and spirit of the invention as disclosed in the accompanying claims.

What is claimed is:

1. A golf tee comprising a cylindrical tee member having inner and outer surfaces and an apertured stop plate at a predetermined portion of the inner surface thereof to form a recess therein, and an elongated tee member having a head part and a leg part, said head part of said elongated tee member being detachably fitted into the recess and in abutment with said apertured stop plate of the cylindrical tee member, said cylindrical tee member further comprising a supporting plate at a side of the outer surface and a cylindrical head part arranged on the outer surface opposite of the supporting plate.

* * * * *